US005518395A

United States Patent [19]

Maughan

[11] Patent Number: 5,518,395

[45] Date of Patent: May 21, 1996

[54] ENTRAINMENT FUEL NOZZLE FOR PARTIAL PREMIXING OF GASEOUS FUEL AND AIR TO REDUCE EMISSIONS

[75] Inventor: James R. Maughan, Scotia, N.Y.

[73] Assignee: General Electric Company, Schenectady, N.Y.

[21] Appl. No.: 303,558

[22] Filed: Sep. 9, 1994

Related U.S. Application Data

[63] Continuation of Ser. No. 54,478, Apr. 30, 1993, abandoned.

[51] Int. Cl.[6] ..... F23C 5/00

[52] U.S. Cl. ..... 431/8; 431/181; 431/183; 431/354; 239/427.5

[58] Field of Search ..... 431/181, 183, 431/187, 8, 9, 10, 351, 354, 353, 328, 326, 355; 239/8, 427.3, 427.5

[56] References Cited

U.S. PATENT DOCUMENTS

| | | | |
|---|---|---|---|
| 795,044 | 7/1905 | Kraus | 239/427.5 |
| 1,874,970 | 8/1932 | Hall | 431/354 |
| 1,961,751 | 6/1934 | Feyling | 431/354 |
| 2,250,680 | 7/1941 | Schlitt | 431/351 |
| 3,358,736 | 12/1967 | Reed et al. | 431/181 |
| 3,940,234 | 2/1976 | Reed et al. | 431/181 |
| 4,130,388 | 12/1978 | Flanagan | 431/352 |
| 4,383,820 | 5/1983 | Camacho | 431/181 |
| 4,575,332 | 3/1986 | Oppenberg et al. | 431/183 |
| 4,752,213 | 6/1988 | Grochowski | 431/328 |
| 5,062,788 | 11/1991 | Best | 431/354 |
| 5,163,830 | 11/1992 | Pfefferkorn | 431/354 |
| 5,165,606 | 11/1992 | Pelet | 239/427.5 |
| 5,240,409 | 8/1993 | Xiong | 431/354 |
| 5,247,797 | 9/1993 | Fric et al. | 60/737 |

FOREIGN PATENT DOCUMENTS

| | | | |
|---|---|---|---|
| 1518756 | 3/1968 | France | 431/326 |
| 2517244 | 11/1975 | Germany | 239/427.5 |
| 2542719 | 4/1977 | Germany | 431/328 |
| 1537958 | 1/1990 | U.S.S.R. | 431/181 |

*Primary Examiner*—James C. Yeung
*Attorney, Agent, or Firm*—Patrick K. Patnode; Paul R. Webb, II

[57] ABSTRACT

This invention relates to fuel nozzles of the type that employ an entrainment fuel nozzle for initial, partial premixing of gaseous fuel and air. Such structures of this type, generally, use the gas jet to entrain surrounding air so that the fuel is somewhat diluted prior to injection into the combustor.

7 Claims, 3 Drawing Sheets

ENTRAINMENT FUEL NOZZLE FOR PARTIAL PREMIXING OF GASEOUS FUEL AND AIR TO REDUCE EMISSIONS

This application is a Continuation of application Ser. No. 08/054,478 filed Apr. 30, 1993 now abandoned.

BACKGROUND OF THE INVENTION

1. Field of the Invention

This invention relates to fuel nozzles of the type that employ an entrainment fuel nozzle for initial, partial premixing of gaseous fuel and air. Such structures of this type, generally, use the gas jet to entrain surrounding air so that the fuel is somewhat diluted prior to injection into the combustor.

2. Description of the Related Art

The foremost combustor concept for low NOx emissions, lean premixed combustion, requires that fuel and air be well premixed prior to ignition. In practice, and particularly when retrofitting existing machines, this high degree of premixing is difficult to achieve, resulting in localized fuel-rich regions and the associated NOx generation. For example, FIG. 1 illustrates a conventional combustor 2. Combustor 2 includes, in part, casing 4, air inlet 6, liner 8, dilution holes 9, combustion chamber 10, fuel spoke 14, flow sleeve 16, swirler 18, and exhaust 20.

During the operation of a conventional premixed combustor 2, air enters in through inlet 6 along the direction of arrow A and enters into casing 4. Combustion air then enters combustion chamber 10 through swifter 18 along the direction of arrows B'. While air enters combustion chamber 10, gaseous fuel is injected through fuel spokes 14 along the direction of arrows D. This fuel is then swirled by swifter 18 and enters combustion chamber 10. As the air and fuel enter into combustion chamber 10, they are combusted. After they are combusted, dilution air mixes in through dilution holes 9 along the direction of arrows B. The additional air which enters from B serves primarily to drop temperature after combustion is complete. After the fuel and air are combusted and mix with the dilution air they are exhausted through exhaust 20 along the direction of arrow E.

The manner in which fuel and air are introduced into combustion chamber 10 generally results in poor mixing prior to combustion. As discussed earlier, these fuel-rich regions result in increased NOx production. Although efforts have been made to effect better premixer and swifter designs in order to achieve increased mixing and reduced NOx, it would also be desirable to dilute the fuel concentration prior to injection into the combustion chamber to achieve partial premixing of the fuel within the fuel nozzle. This partial premixing would further reduce the fuel concentration within the fuel rich regions in the combustion chamber. Such premixing and the associated NOx reduction would be particularly advantageous in situations where major modifications of the combustion system to a fully premixed design are not possible or practical.

As can be seen in FIG. 2, premixing air into the fuel line of a conventional diffusion combustor of the type shown generally in FIG. 1 results in a drop in NOx emissions. NOx emissions in the combustor exhaust are shown to decrease as air is mixed into the gaseous fuel prior to the nozzle and introduction into the combustor. This drop is larger than can be simply explained by a drop in the overall air/fuel ratio, as the combustor exit temperature is held constant. Diluting the fuel with air prior to combustion increases mixing and reduces NOx production. However, presently there are no combustors which exhibit this premixing and dilution of the fuel within the fuel nozzle.

Obstacles to this technology have, up to this point, included the need for an additional air compressor (particularly difficult for a retrofit), added control complexity, and the danger of creating a combustible or explosive mixture outside the combustion chamber 10. Therefore, a more advantageous combustor, then, would be presented if there would be an initial premixing of the fuel in air in a more simplified manner.

It is apparent from the above that there exists a need in the art for a combustor which is able to premix the fuel and air, and which at least equals the combustion characteristics of the known combustors, but which at the same time is capable of premixing the fuel and air prior to the fuel and air being injected into the premixing chamber. It is a purpose of this invention to fulfill this and other needs in the art in a manner more apparent to the skilled artisan once given the following disclosure.

SUMMARY OF THE INVENTION

Generally speaking, this invention fulfill these needs by providing a fuel nozzle for a low NOx combustor, comprising a fuel inlet means having a reduced cross-sectional area, a first air inlet means located adjacent to said reduced cross-sectional area, an expansion area having first and second ends such that said first end is located adjacent to said first air inlet means, a fuel and air outlet means located adjacent to said second end of said expansion area, a second air inlet means located adjacent to said fuel and air inlet means, a fuel and air mixing means located adjacent to said fuel and air outlet means and said second air inlet means, and a combustion chamber located adjacent to said swifter means for combusting said fuel and air.

In certain preferred embodiments, the reduced cross-sectional area is a throat. Also, the first air inlet means are air entrainment holes and are four in number. Finally, the expansion area increases in cross-sectional area from the reduced area towards the fuel and air outlet means.

In another further preferred embodiment, the fuel nozzle achieves initial premixing of the fuel and air in a simplified manner by using the gas jet to entrain surrounding air.

The preferred fuel nozzle, according to this invention, offers the following advantages: excellent fuel and air premixing characteristics; reduced NOx; good stability; good durability; good economy; and high strength for safety. In fact, in many of the preferred embodiments, these factors of fuel and air premixing and reduced NOx are optimized to an extent that is considerably higher than heretofore achieved in prior, known combustors.

BRIEF DESCRIPTION OF THE DRAWINGS

The above and other features of the present invention which will be more apparent as the description proceeds are best understood by considering the following detailed description in conjunction with the accompanying drawings wherein like character represent like parts throughout the several views and in which.

DETAILED DESCRIPTION OF THE INVENTION

Figure 1:
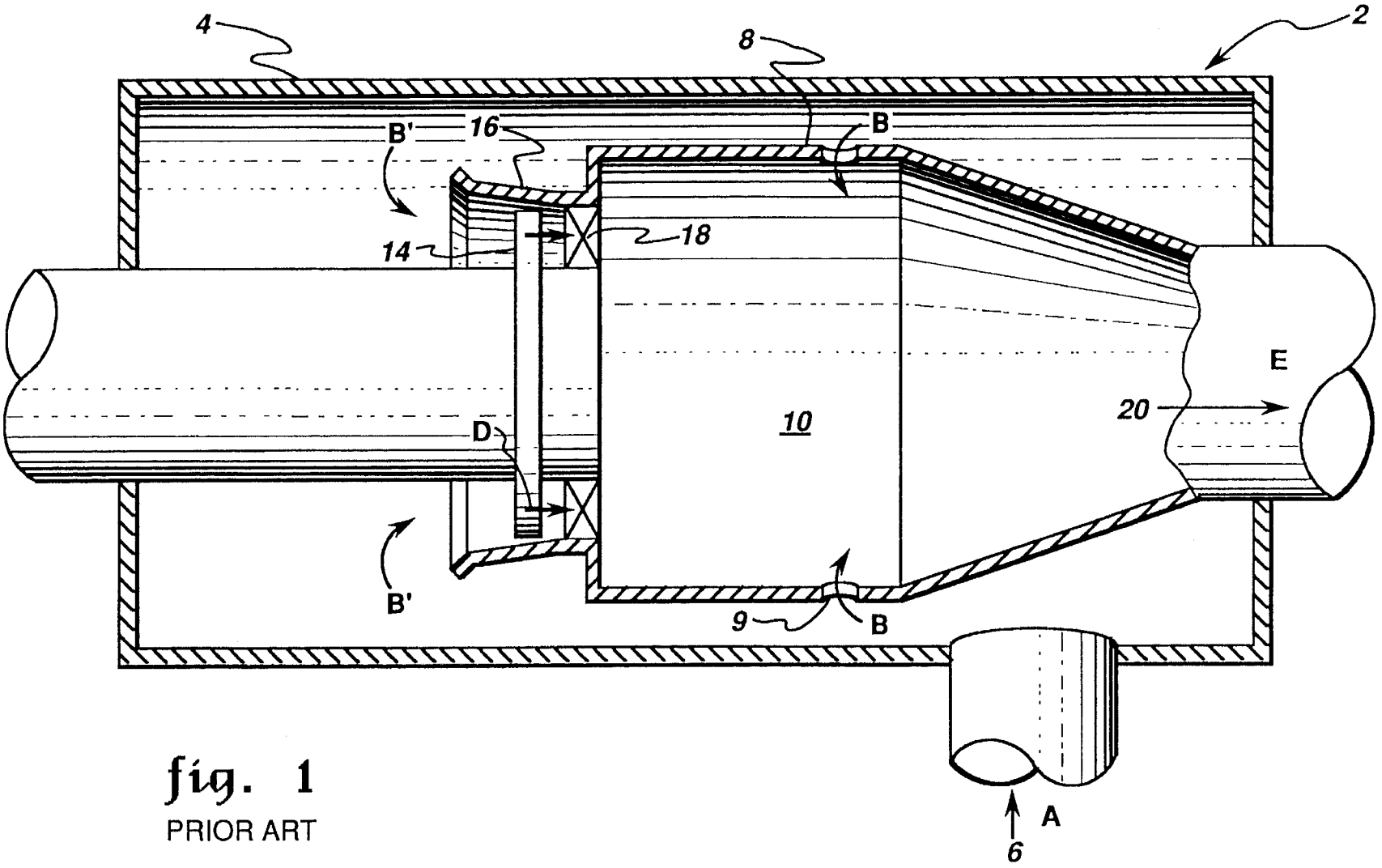
fig. 1 PRIOR ART
FIG. 1 is a schematic illustration of a conventional combustor, according to the prior art.
Figure 2:
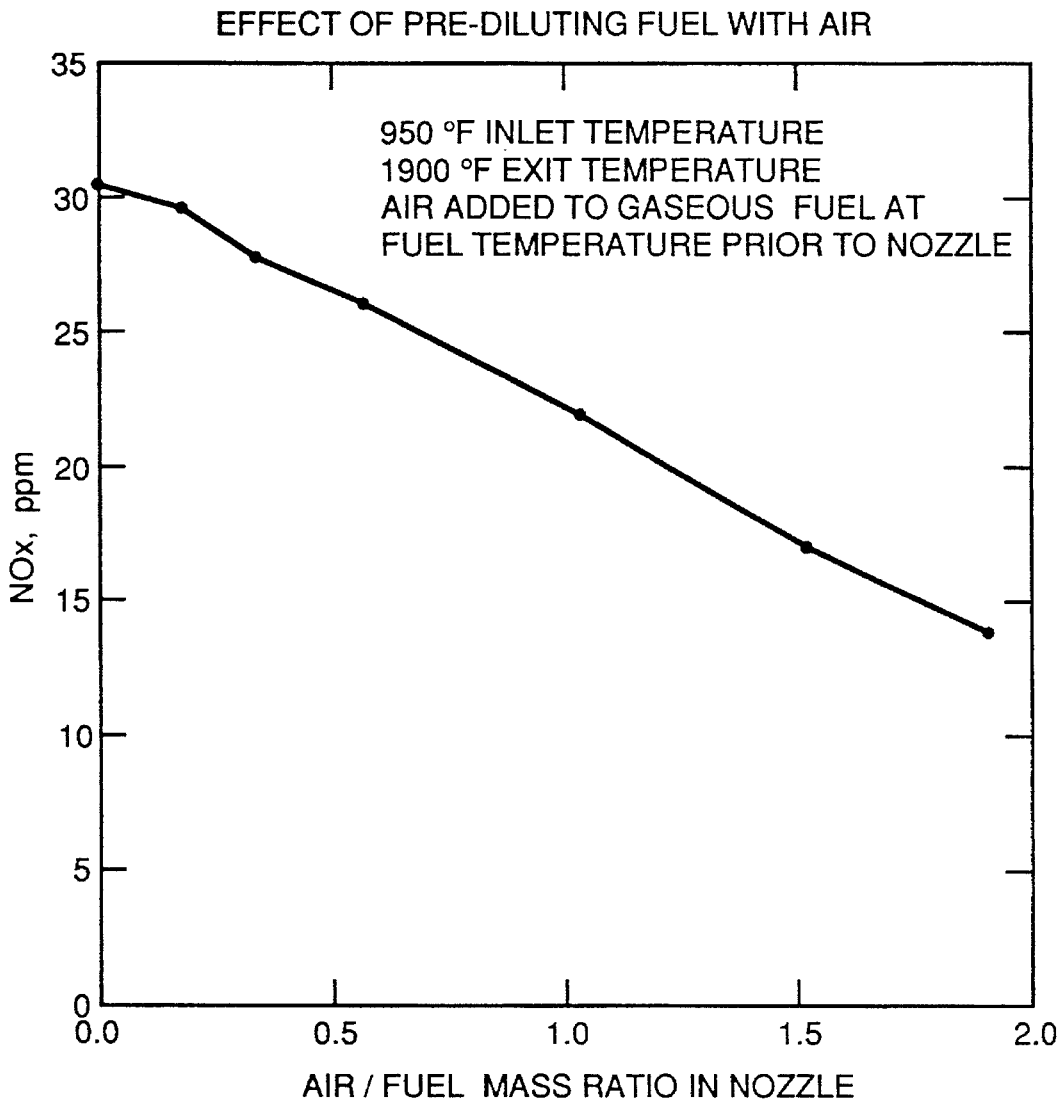
FIG. 2 is a graphical illustration of the effect of predilution fuel with air on NOx emissions, in ppm, versus the air/fuel ratio in the nozzle, for a combustor of the type shown in FIG. 1.

As discussed earlier, FIG. 1 illustrates a conventional combustor 2. Combustor 2 includes, in part, casing 4, air inlet 6, liner 8, dilution holes 9, combustion chamber 10, fuel spoke 14, flow sleeve 16, air swifter 18, and exhaust 20. Also, as discussed earlier, in order to achieve low NOx emissions, the fuel and air must be well premixed prior to ignition. However, with respect to combustor 2, this premixing is difficult to achieve which results in localized fuel-rich regions and associated NOx generation.

Figure 3:
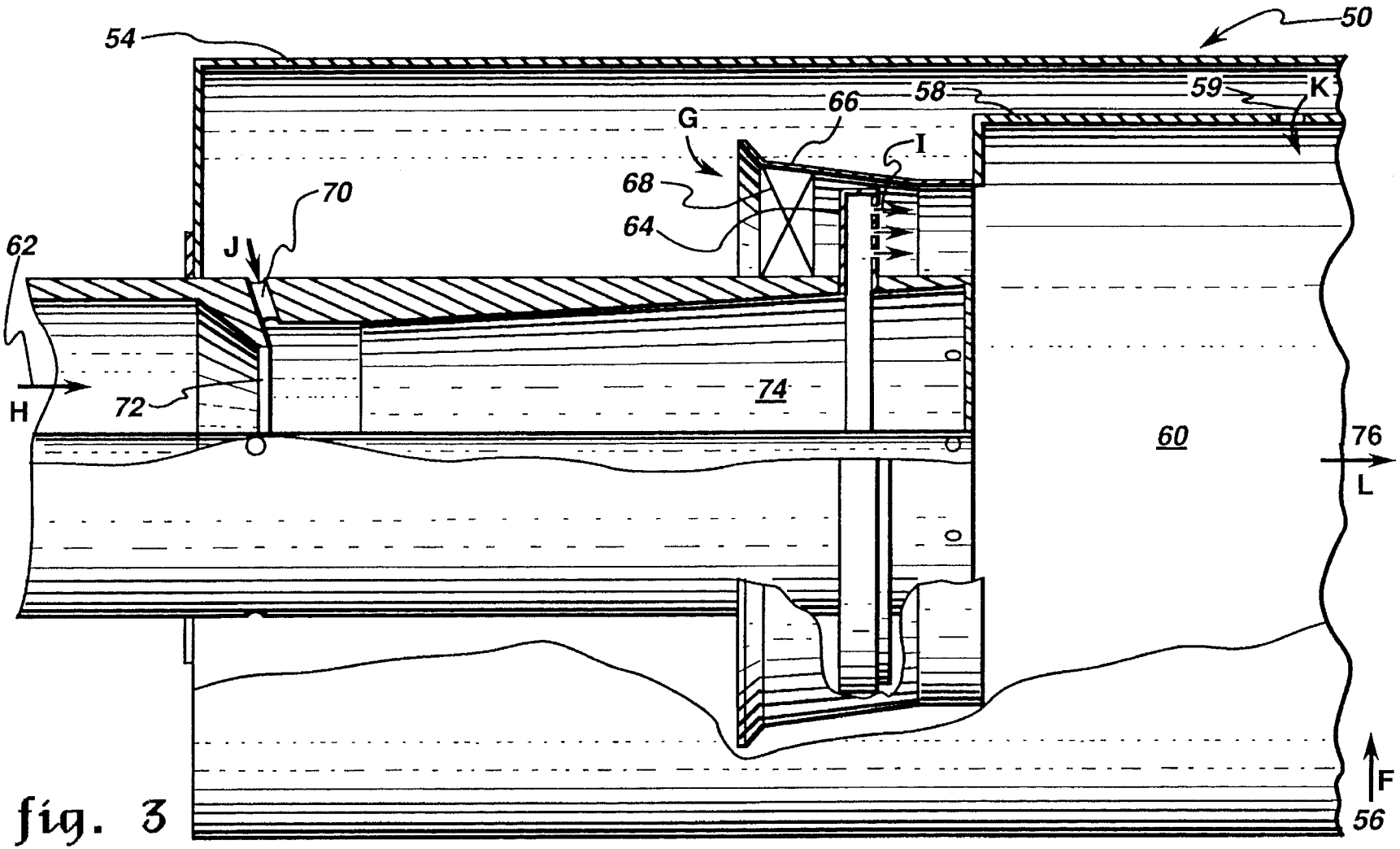
FIG. 3 is a schematic illustration of a fuel nozzle for initial, partial premixing of gaseous fuel and air, according to the present invention.

FIG. 3 is a schematic illustration of a combustor 50 having an entrainment fuel nozzle for initial, partial premixing of gaseous fuel and air. Combustor 50 includes, in part, conventional casing 54, conventional air inlet 56 (not shown), conventional liner 58, conventional dilution holes 59, conventional combustion chamber 60, conventional fuel inlet 62, conventional fuel spoke 64, conventional flow sleeve 66, conventional air swifter 68, air entrainment hole 70, throat 72, expansion area 74, and conventional exhaust 76 (not shown). In particular, there are four air entrainment holes located within combustor 50. Also, expansion area 74 increases in cross-sectional area from throat 72 toward fuel spoke 64.

During the operation of combustor 50, air is inlet along the direction of arrow F through inlet 56. The air enters into casing 54. While in casing 54, the air goes past flow sleeve 66 and enters swifter 68 along the direction of arrow G. Also air enters air entrainment hole 70 along the direction of arrow J. As air is entering through swifter 68 and air entrainment hole 70, fuel, typically, natural gas enters through fuel inlet 62 along the direction of arrow H.

As fuel enters in through fuel inlet 62, typically, at a pressure of approximately 220 psi, this fuel interacts with throat 72. Because of the nature of design of throat 72, the pressure of the fuel is, typically, dropped to approximately 180 psi. Typically, air is inlet through inlet 56 at approximately 190 psi. Because the fuel is at approximately 180 psi near throat 72, air is allowed to enter through entrainment hole 70 into expansion area 74. While air is entering into expansion area 74 through entrainment air hole 70, fuel from throat 72 interacts with the air entering through air entrainment hole 70 to premix and expand in area 74. This premixed fuel and air then enters in through fuel spoke 64 and is ejected out of fuel spoke 64 along the direction of arrow I. This premixed fuel and air then contacts air having passed through swifter 68, which swifts the air and fuel mixture further and injects the premixed fuel and air into combustion chamber 60. The premixed fuel and air is then combusted in combustion chamber 60. Also, as the fuel and air are combusted, air enters through dilution holes 59 along the direction of arrow K. Finally, the combusted fuel and air and the air from dilution holes 59 are exhausted out of exhaust 76 along the direction of arrow L.

The current concept differs from the conventional combustor in that the gas, before approaching the fuel spoke 64, first passes through throat 72 where the static pressure of the fuel drops below the air pressure in casing 54. Air from the casing 54 enters the fuel nozzle through air entrainment holes 70 and mixes in a constant momentum process within the throat 72. Static pressure recovery occurs in the expansion area 74.

Because there is an approximate 3% pressure drop across the swifter 68, air pressure outside the fuel nozzle is already relatively high and assists in the air entrainment process. Otherwise, excessively high velocities in throat 72 would be required. It has been calculated that the entire process would require raising the gas supply pressure, typically, from 200 to 220 psi.

Once given the above disclosure, many other features, modification or improvements will become apparent to the skilled artisan. Such features, modifications or improvements are, therefore, considered to be a part of this invention, the scope of which is to be determined by the following claims.

What is claimed is:

1. A combustor for reducing NOx emissions comprising:

a casing having an inlet for receiving air under pressure;

a combustor liner disposed inside said casing to define a combustion chamber;

a flow sleeve joined to an upstream end of said combustor liner and in flow communication with said casing inlet for channeling a first portion of said pressurized air into said combustion chamber from said casing inlet;

a fuel nozzle extending into said casing and having an inlet for receiving a gaseous fuel, a throat disposed in flow communication with said fuel inlet for decreasing pressure of said fuel, a plurality of air entrainment holes extending radially through said nozzle for allowing said fuel to entrain a second portion of said pressurized air into said nozzle downstream of said throat for forming an air and fuel premixture, an expansion area disposed downstream from said throat for receiving said premixture and recovering pressure, and a fuel spoke extending radially outwardly from a downstream end of said expansion area inside said flow sleeve for discharging said premixture into said flow sleeve for mixing with said air first portion for flow together into said combustion zone.

2. A combustor according to claim 1 further comprising an air swirler extending radially between said fuel nozzle and said flow sleeve, and disposed upstream of said fuel spoke for swirling said air first portion and effecting a pressure drop across said swirler prior to mixing with said premixture to assist entrainment of said air second portion through said entrainment holes.

3. A combustor according to claim 2 wherein said throat is sized to decrease said pressure of said fuel at said throat below said air pressure.

4. A combustor according to claim 2 further comprising:

means for providing said air into said casing inlet under pressure;

means for providing said fuel to said nozzle inlet at a fuel first pressure; and said throat being sized to reduce said fuel first pressure to a lower fuel second pressure, with said fuel first pressure being greater than said air pressure, and said fuel second pressure being less than said air pressure.

5. A method for reducing NOx emissions from a combustion chamber in a combustor comprising:

channeling air under pressure to said combustor;

dividing said air into first and second portions;

channeling fuel under pressure to said combustor to entrain said air second portion with said fuel to form a premixture;

mixing said premixture with said air first portion;

channeling said premixture and mixed air first portion into said combustion chamber for undergoing combustion with reduced NOx emissions therefrom; and accelerating said fuel to form a fuel jet for reducing said fuel pressure relative to said air pressure to entrain said air second portion wherein said fuel pressure is reduced from a first pressure to a second pressure, and said fuel first pressure is greater than said air pressure, and said fuel second pressure is less than said air pressure.

6. A method according to claim 5 further comprising expanding said premixture prior to said mixing with said air first portion for recovering pressure.

7. A method according to claim 6 further comprising swirling said air first portion prior to mixing with said premixture to effect a pressure drop in said air first portion to assist said entraining of said air second portion.

* * * * *